US011333989B2

(12) United States Patent
Unno et al.

(10) Patent No.: US 11,333,989 B2
(45) Date of Patent: May 17, 2022

(54) TONER

(71) Applicant: CANON KABUSHIKI KAISHA, Tokyo (JP)

(72) Inventors: Tomohiro Unno, Numazu (JP); Kosuke Fukudome, Tokyo (JP); Ryo Nagata, Tokyo (JP); Tetsuya Kinumatsu, Mishima (JP); Mariko Yamashita, Suntou-gun (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/908,857

(22) Filed: Jun. 23, 2020

(65) Prior Publication Data

US 2020/0409282 A1 Dec. 31, 2020

(30) Foreign Application Priority Data

Jun. 27, 2019 (JP) ..... JP2019-120149

(51) Int. Cl.
*G03G 9/087* (2006.01)
*G03G 9/08* (2006.01)
*G03G 9/097* (2006.01)

(52) U.S. Cl.
CPC ..... *G03G 9/08711* (2013.01); *G03G 9/0819* (2013.01); *G03G 9/08755* (2013.01); *G03G 9/09733* (2013.01)

(58) Field of Classification Search
CPC ..... G03G 9/08782; G03G 9/0825
See application file for complete search history.

(56) References Cited

U.S. PATENT DOCUMENTS

| | | | |
|---|---|---|---|
| 8,603,712 | B2 | 12/2013 | Aoki et al. |
| 8,741,519 | B2 | 6/2014 | Watanabe et al. |
| 8,785,101 | B2 | 7/2014 | Kaya et al. |
| 8,846,284 | B2 | 9/2014 | Kinumatsu et al. |
| 9,034,549 | B2 | 5/2015 | Shiotari et al. |
| 9,040,216 | B2 | 5/2015 | Fukudome et al. |
| 9,116,448 | B2 | 8/2015 | Terauchi et al. |

(Continued)

FOREIGN PATENT DOCUMENTS

| | | |
|---|---|---|
| JP | 2003-280246 | 10/2003 |
| JP | 2017-207680 | 11/2017 |
| JP | 2017-211648 | 11/2017 |

OTHER PUBLICATIONS

U.S. Appl. No. 16/864,273, Mariko Yamashita, filed May 1, 2020.

(Continued)

*Primary Examiner* — Peter L Vajda
(74) *Attorney, Agent, or Firm* — Venable LLP

(57) ABSTRACT

A toner containing a toner particle that contains a binder resin and a crystalline material, wherein, in measurement of powder dynamic viscoelasticity of the toner, when T(A)° C. is taken as an onset temperature for a storage elastic modulus E' obtained at a ramp rate of 20° C./min, EA'(100) Pa is taken as a storage elastic modulus at 100° C. obtained at a ramp rate of 20° C./min, and T(B)° C. is taken as an onset temperature for a storage elastic modulus E' obtained at a ramp rate of 5° C./min, T(A)−T(B) is 3.0° C. or less, T(A) is from 45.0° C. to 70.0° C., and EA'(100) is from $4.0\times10^9$ Pa to $6.5\times10^9$ Pa.

9 Claims, 1 Drawing Sheet

(56) References Cited

U.S. PATENT DOCUMENTS

| | | | |
|---|---|---|---|
| 9,134,637 | B2 | 9/2015 | Hotta et al. |
| 9,141,012 | B2 | 9/2015 | Moribe et al. |
| 9,256,148 | B2 | 2/2016 | Fujikawa et al. |
| 9,261,806 | B2 | 2/2016 | Moribe et al. |
| 9,285,697 | B2 | 3/2016 | Fukudome et al. |
| 9,309,349 | B2 | 4/2016 | Watanabe et al. |
| 9,429,860 | B2 | 8/2016 | Kinumatsu et al. |
| 9,470,993 | B2 | 10/2016 | Nishikawa et al. |
| 9,594,323 | B2 | 3/2017 | Fujikawa et al. |
| 9,606,462 | B2 | 3/2017 | Nomura et al. |
| 9,625,844 | B2 | 4/2017 | Kaya et al. |
| 9,658,554 | B2 | 5/2017 | Kinumatsu et al. |
| 9,798,256 | B2 | 10/2017 | Kosaki et al. |
| 9,798,262 | B2 | 10/2017 | Toyoizumi et al. |
| 9,811,016 | B2 | 11/2017 | Aoki et al. |
| 9,823,595 | B2 | 11/2017 | Toyoizumi et al. |
| 9,857,713 | B2 | 1/2018 | Kosaki et al. |
| 9,869,943 | B2 | 1/2018 | Aoki et al. |
| 9,964,881 | B2 | 5/2018 | Ikejiri et al. |
| 9,971,263 | B2 | 5/2018 | Fukudome et al. |
| 10,101,683 | B2 | 10/2018 | Nishikawa et al. |
| 10,197,934 | B2 | 2/2019 | Matsui et al. |
| 10,289,016 | B2 | 5/2019 | Fukudome et al. |
| 10,295,920 | B2 | 5/2019 | Nishikawa et al. |
| 10,295,921 | B2 | 5/2019 | Ohmori et al. |
| 10,303,075 | B2 | 5/2019 | Tanaka et al. |
| 10,409,180 | B2 | 9/2019 | Koji et al. |
| 10,545,420 | B2 | 1/2020 | Kinumatsu et al. |
| 10,578,990 | B2 | 3/2020 | Tsuda et al. |
| 10,747,136 | B2 | 8/2020 | Kenmoku et al. |
| 2015/0064617 | A1* | 3/2015 | Magome ..... G03G 9/09364 430/108.4 |
| 2016/0291494 | A1* | 10/2016 | Kinumatsu ..... G03G 9/09392 |
| 2019/0041762 | A1 | 2/2019 | Yoshiba et al. |
| 2019/0137900 | A1* | 5/2019 | Nakagawa ..... G03G 9/08797 |
| 2020/0103774 | A1 | 4/2020 | Fukudome et al. |
| 2020/0103776 | A1 | 4/2020 | Kinumatsu et al. |
| 2020/0166861 | A1 | 5/2020 | Uratani et al. |
| 2020/0183293 | A1 | 6/2020 | Kinumatsu et al. |
| 2020/0183294 | A1 | 6/2020 | Fukudome et al. |
| 2020/0183296 | A1 | 6/2020 | Nishikawa et al. |

OTHER PUBLICATIONS

U.S. Appl. No. 16/864,341, Ryo Nagata, filed May 1, 2020.
U.S. Appl. No. 16/908,885, Tetsuya Kinumatsu, filed Jun. 23, 2020.

* cited by examiner

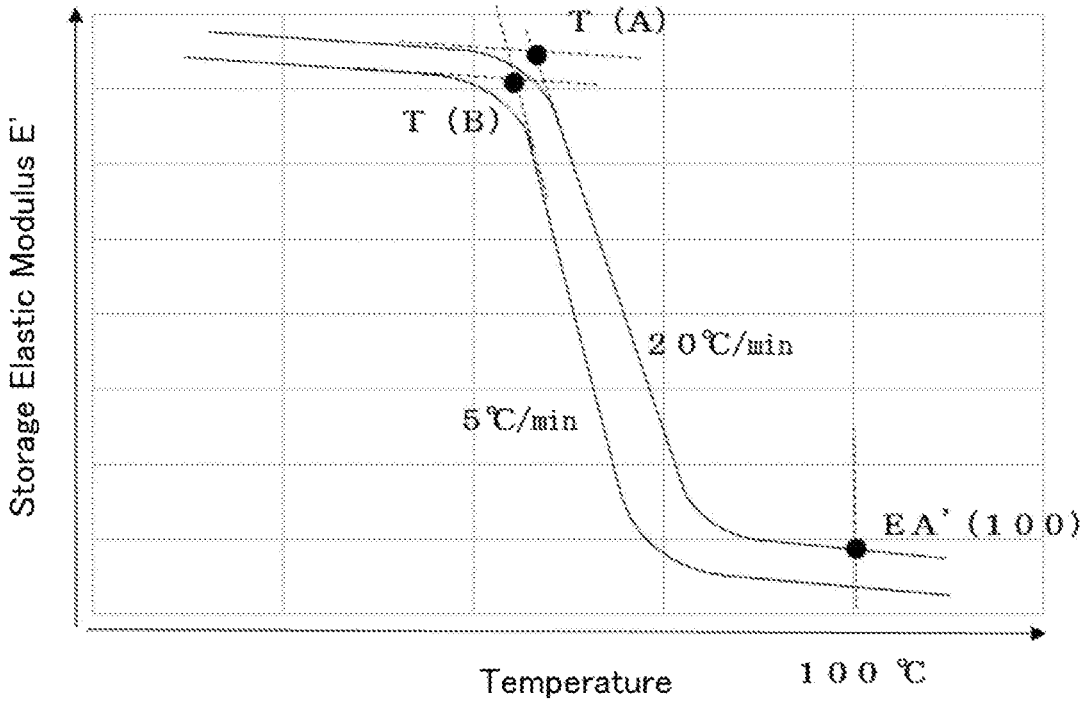
T (A)
T (B)
20℃/min
5℃/min
EA' (100)
Storage Elastic Modulus E'
Temperature
100 ℃

TONER

BACKGROUND OF THE INVENTION

Field of the Invention

The present disclosure relates to a toner used in electrophotography.

Description of the Related Art

Image-forming devices, e.g., copiers, printers, and so forth, have been subject in recent years to an increasing diversification of intended applications and use environments, and in combination with this have been subject to demands for greater energy savings, higher speeds, and higher image qualities. Toner exhibiting additional improvements in low-temperature fixability is required from the standpoint of improving the energy savings associated with the toner.

Crystalline materials, e.g., waxes, crystalline polyesters, and so forth, are used to improve the low-temperature fixability of toners. Crystalline materials promote toner melting and deformation by melting at the melting point possessed by such materials and plasticizing the binder resin in the toner. Japanese Patent Application Laid-open No. 2017-211648 describes improvements in the low-temperature plasticizing performance achieved through the use of crystalline polyester. It is stated that this can prevent cold offset, i.e., where, due to an inadequate melting of the toner, toner adheres to the fixing film during passage through the fixing nip and is then fixed to the paper after one revolution in this condition has occurred.

In addition, the sharp melt property can be improved by dispersing such a crystalline material in the toner as microdomains. It is stated in Japanese Patent Application Laid-open No. 2017-207680 that, by regulating the domains of a crystalline polyester or low-melting wax, the storability at elevated temperatures can be made to coexist in good balance with the low-temperature fixability provided by the sharp melt property.

Moreover, Japanese Patent Application Laid-open No. 2003-280246 discloses that an excellent fixing performance from a low-temperature region to a high-temperature region for the fixation temperature is exhibited by toner having a controlled content in the binder resin of a crosslinking agent component as well as a controlled content of a prescribed compound and a derivative of said compound.

SUMMARY OF THE INVENTION

With the toners having an improved low-temperature fixability that are described in Japanese Patent Application Laid-open Nos. 2017-211648 and 2017-207680, a problem occurs with the fixing performance under those circumstances in which high temperatures readily occur in association with an increase in the amount of heat received by the paper and fixing roller due to increased speeds. In specific terms, it has been difficult to prevent fixing non-uniformity by the toner under the circumstance whereby, in the high-speed printing of thick paper, the temperature on the paper during fixing readily assumes high values. The fixing non-uniformity at high temperature referenced here refers to the following: with thick paper, for which heat is readily transferred to the paper during fixing in high-speed printing, an excessive melt-spreading of the toner cannot be prevented in particular in those regions where high temperatures are readily assumed, e.g., protruded portions of the paper, and fixing non-uniformity ends up being produced at the depressed portions and protruded portions of the paper. This phenomenon is also referred to in the following as "high-temperature fixing non-uniformity".

The application of the methodology described in Japanese Patent Application Laid-open No. 2003-280246 has also been investigated. However, the application of the methodology described in Japanese Patent Application Laid-open No. 2003-280246 ends up also preventing the plasticizing performance at low temperatures and the sharp melt property. As a consequence, there is a tendency for the low-temperature fixability to be reduced and for a trade off to appear with the fixing non-uniformity that occurs due to the appearance of fixing non-uniformity with protruded portions arising from the difficulty of melting by the toner in depressed portions of the paper at low temperatures (also referred to in the following as "low-temperature fixing non-uniformity"). As a consequence, it has been a major problem to achieve coexistence between prevention of the high-temperature fixing non-uniformity, on the one hand, and the low-temperature fixability and prevention of the low-temperature fixing non-uniformity on the other.

The present disclosure provides a toner that exhibits an excellent low-temperature fixability and is able to prevent fixing non-uniformity regardless of the media, even when printer energy savings, speed, and image quality are increased or improved.

The toner of the present disclosure is a toner containing a toner particle that contains a binder resin and a crystalline material, wherein in measurement of powder dynamic viscoelasticity of the toner, when T(A)° C. is taken as an onset temperature for a storage elastic modulus P obtained at a ramp rate of 20° C./min, EA'(100) Pa is taken as a storage elastic modulus at 100° C. obtained at a ramp rate of 20° C./min, and T(B)° C. is taken as an onset temperature for a storage elastic modulus E' obtained at a ramp rate of 5° C./min, the following formulas (1), (2), and (3) are satisfied:

$$T(A)-T(B)\leq 3.0^\circ\ \text{C.} \quad (1)$$

$$45.0^\circ\ \text{C.}\leq T(A)\leq 70.0^\circ\ \text{C.} \quad (2)$$

$$4.0\times 10^9\ \text{Pa}\leq EA'(100)\leq 6.5\times 10^9\ \text{Pa} \quad (3).$$

According to the present disclosure, a toner that exhibits an excellent low-temperature fixability and is able to prevent fixing non-uniformity regardless of the media can be provided.

Further features of the present invention will become apparent from the following description of exemplary embodiments with reference to the attached drawings.

BRIEF DESCRIPTION OF THE DRAWINGS

The FIGURE is a diagram of the results of measurement of the powder dynamic viscoelasticity of toner.

DESCRIPTION OF THE EMBODIMENTS

On the occasion of intensive investigations carried out by the present inventors, it was found that, through the use of the toner as described in the following, an excellent low-temperature fixability can be exhibited and the fixing non-uniformity can be prevented regardless of the media.

Embodiments for execution of the present disclosure are described in detail in the following.

The toner of the present disclosure is a toner containing a toner particle that contains a binder resin and a crystalline material, wherein in measurement of powder dynamic viscoelasticity of the toner, when T(A)° C. is taken as an onset temperature for a storage elastic modulus E' obtained at a ramp rate of 20° C./min, EA'(100) Pa is taken as a storage elastic modulus at 100° C. obtained at a ramp rate of 20° C./min, and T(B)° C. is taken as an onset temperature for a storage elastic modulus E' obtained at a ramp rate of 5° C./min, the following formulas (1), (2), and (3) are satisfied:

$$T(A)-T(B)\leq 3.0^\circ\ \text{C.} \quad (1)$$

$$45.0^\circ\ \text{C.}\leq T(A)\leq 70.0^\circ\ \text{C.} \quad (2)$$

$$4.0\times 10^9\ \text{Pa}\leq EA'(100)\leq 6.5\times 10^9\ \text{Pa} \quad (3).$$

Measurement of the powder dynamic viscoelasticity primarily can elucidate the melt state in the neighborhood of the toner surface as a function of temperature. The specific measurement procedure, which is described below, has a mechanism that is different from that in other viscoelasticity measurements. Since the toner can be measured without molding the toner, e.g., pelletization, it is thought that this procedure can measure the softening of the toner surface. As a result of investigations by the present inventors, it was found that the aforementioned three parameters provided by the measurement make a major contribution to the fixing performance of toner.

Formula (1) shows the degree to which the temperature of melting onset for the toner is dependent on the ramp rate. This is thought to correlate with the fixing non-uniformity at low temperature. The reason for this is due to the following: it is thought that a smaller dependence on the ramp rate results, even if there are differences in the amount of heat received by the toner, in a greater prevention of differences in the melting onset temperature, i.e., in a smaller fixing non-uniformity.

By restraining, in accordance with the present disclosure, the dependence on the ramp rate by the temperature of melting onset for the toner, it is thought that the toner then undergoes satisfactory melting even in the depressed portions of the paper, where it is difficult for the heat to reach, and fixing non-uniformity over the protruded and depressed portions of the paper is inhibited. When T(A)−T(B) 3.0° C., fixing non-uniformity can then be satisfactorily prevented even at melting onset, i.e., low temperatures.

T(A)−T(B) is preferably less than or equal to 2.0° C. and is more preferably less than or equal to 1.5° C. The lower limit for T(A)−T(B) is not particularly limited, but is preferably greater than or equal to 0.5° C. Any combination of these numerical value ranges may be used.

T(A)−T(B) can be adjusted, e.g., through the use of crystalline materials that have a low melting point, through the use of crystalline materials that have a high compatibility with the binder resin, and through the dispersion/immobilization of a crystalline material in the toner particle.

Formula (2) indicates that the melting onset temperature for the toner is in a certain temperature region. It is thought that this indicates that an excellent fixing performance is exhibited while achieving prevention of the phenomenon in which, during fixing at high temperatures where the toner readily melts, the attachment force between the toner and fixing roller is too high and transfer to the paper does not occur (this is also referred to as "hot offset" in the following). The reason for this is due to the following: it is thought that when the toner melting onset temperature is too low, the attachment force is then too high during fixing at high temperatures; and conversely that the low-temperature fixability becomes unsatisfactory when the melting onset temperature is too high.

Hot offset is readily prevented when 45.0° C. T(A), and a satisfactory low-temperature fixability is obtained when T(A)≤70.0° C.

T(A) is preferably from 45.0° C. to 65.0° C. and is more preferably from 50.0° C. to 60.0° C. T(A) can be adjusted, e.g., through the use of crystalline materials having a low melting point, through the use of crystalline materials that have a high compatibility with the binder resin, and through control of the structure of the binder resin.

Formula (3) is considered to indicate that, in a range in which toner melt-spreading at low temperatures is not impeded, fixing non-uniformity can also be prevented at high temperatures. The reason for this is due to the following: it is thought that excessive toner melt-spreading at high temperatures is inhibited through a high storage elastic modulus at 100° C. In addition, it is thought that not exceeding the upper limit on the storage elastic modulus shown in formula (3) provides a range in which melt-spreading of the toner is not impeded. It is thought that, by satisfying formula (3), while raising the elasticity of the toner without impairing the melt-spreading required during fixing, excessive melt-spreading is then also inhibited at the protruded portions, which are readily reached by the heat, and a trend is established of an excellent prevention of fixing non-uniformity over the depressed and protruded portions of the paper even for thick paper during high-speed printing.

Excessive melt-spreading at high temperatures can be satisfactorily inhibited when $4.0\times 10^9$ Pa≤EA'(100) is satisfied; melt-spreading is not impaired when EA'(100)≤$6.5\times 10^9$ Pa is satisfied.

EA'(100) is preferably from $4.5\times 10^9$ Pa to $6.0\times 10^9$ Pa.

EA'(100) can be adjusted, e.g., through adjustment of the structure of the binder resin through judicious changes in the polymerizable monomer that can form the binder resin.

Simultaneously satisfying formulas (1) to (3) has heretofore been highly problematic, but the present inventors were able to achieve this based on intensive investigations. This has made it possible to provide an excellent low-temperature fixability and to prevent fixing non-uniformity regardless of the media, even when printer energy savings, speed, and image quality are increased or improved.

Preferred embodiments of the toner according to the present disclosure are described in the following.

T(B) is preferably from 45.0° C. to 65.0° C. and is more preferably from 50.0° C. to 60.0° C. T(B) can be adjusted, e.g., through the use of crystalline materials having a low melting point and through control of the structure of the binder resin.

The average number of domains of the crystalline material having a major diameter from 20 nm to 300 nm in the cross section of the toner as observed with a transmission electron microscope is preferably from 50 to 500. By having the average number of these domains be at least 50, a high rate of compatibilization between the crystalline material and the binder resin is provided and the inhibition of fixing non-uniformity at low temperatures is even better. On the other hand, it is thought that by having the average number of these domains be not more than 500, an excessive exudation of the crystalline material is inhibited and an even better inhibition of hot offset is obtained. The number of these domains is more preferably from 100 to 400.

The number of these domains can be better controlled, for example, in the toner production method using suspension polymerization, infra, by using favorable conditions to carry out the cooling step and annealing step that are performed after the toner particle polymerization step. It is thought that this is due to the ability provided by these steps to control the crystallization rate and degree of crystallinity of the crystalline material.

The crystalline material preferably contains an ester wax from the standpoint of the ease of formation of a crystalline state as described above and a high compatibility with the binder resin.

The toner preferably has a peak temperature for the maximum endothermic peak in differential scanning calorimetric measurement of the toner of from 60.0° C. to 90.0° C. Having this peak temperature be at least 60.0° C. provides a better inhibition of excess exudation of the crystalline material and a better inhibition of hot offset. On the other hand, by having this peak temperature be not more than 90.0° C., the compatibility between the crystalline material and binder resin at low temperatures is further enhanced and a greater improvement in the low-temperature fixability is obtained. This peak temperature is more preferably from 60.0° C. to 85.0° C. and is still more preferably from 62.5° C. to 75.0° C.

This peak temperature can be adjusted, for example, by the use of a crystalline material having a low melting point and by controlling the structure of the binder resin.

The content in the toner of tetrahydrofuran-insoluble matter (also referred to in the following as THF-insoluble matter) derived from the binder resin is preferably from 20 mass % to 80 mass %. By having the content of THF-insoluble matter be at least 20 mass %, a higher elasticity is also exhibited at high temperatures and a better inhibition is obtained of the fixing non-uniformity caused by excessive melt-spreading of the toner at high temperatures. On the other hand, by having the content of THF-insoluble matter be not more than 80 mass %, a better inhibition is obtained of the impairment of low-temperature fixing caused by an excessive elasticity. The content of this THF-insoluble matter is more preferably from 25 mass % to 70 mass %.

The content of this THF-insoluble matter can be adjusted, for example, by varying the type and amount of the polymerizable monomer that can form the binder resin, by controlling the structure of the binder resin by, for example, varying the type and amount of crosslinking agent, and the like.

The binder resin preferably contains an ether structure-bearing vinyl resin. The incorporation of an ether structure-bearing vinyl resin in the binder resin provides a higher elasticity also at high temperatures and a better inhibition of the fixing non-uniformity caused by excessive melt-spreading of the toner at high temperatures.

This vinyl resin is preferably a vinyl resin that has been crosslinked by the crosslinking agent given by the following formula (4). A better elasticity at high temperatures and a better flexibility are provided by having this vinyl resin be crosslinked by a crosslinking agent having the structure given in formula (4). As a consequence, a better coexistence is then obtained between the fixing non-uniformity at high temperatures and the prevention of impairment of the fixing performance at low temperatures. Moreover, an excellent image stability, even during high-speed printing, is provided through the formation of a gel which has a higher density and is flexible.

This is thought to be due to the following: the high elasticity increases the rebound force due to toner-to-toner collisions within the cartridge during continuous printing and aggregation is inhibited as a consequence; in addition, even when collisions occur, the impact on the toner can be lessened because the gel itself is an assembly having a flexible chemical structure. As a consequence, even with a crystalline material as in the present disclosure and a toner having a flexible or soft core section, the flowability and durability of the toner are increased and the image stability is excellent even during high-speed printing.

(4)

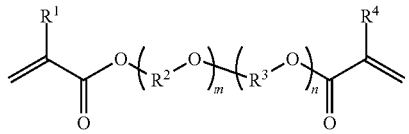

In the formula, m+n is an integer greater than or equal to 2, $R^1$ and $R^4$ are each independently H or $CH_3$, and $R^2$ and $R^3$ are each independently a straight-chain or branched hydrocarbon group (preferably an alkylene group) having from 2 to 12 carbons.

m+n is more preferably an integer greater than or equal to 3. While the upper limit on m+n is not particularly limited, it is preferably an integer less than or equal to 15. Any combination of these numerical value ranges may be used.

$R^2$ and $R^3$ are more preferably each independently a branched hydrocarbon group (preferably an alkylene group) having from 2 to 12 carbons. $R^2$ and $R^3$ are still more preferably each independently a straight-chain or branched hydrocarbon group (preferably an alkylene group) having from 2 to 8 carbons. $R^2$ and $R^3$ are even more preferably each independently a branched hydrocarbon group (preferably an alkylene group) having from 2 to 8 carbons.

The material constituents and production methods that can be used for the toner are described in detail in the following.

The production methods of toner particle and toner are described in detail first.

The toner particle can be produced by any known production method, e.g., a dry method, emulsion polymerization method, dissolution suspension method, suspension polymerization method, and so forth. In dry methods, the toner particle is preferably subjected to a surface modification treatment, e.g., a thermal spherizing treatment, while suspension polymerization is preferred for the polymerization method, with suspension polymerization being particularly preferred. In suspension polymerization, the toner particle is produced by the granulation of a polymerizable monomer composition in an aqueous medium and formation of a particle of the polymerizable monomer composition.

A radical-polymerizable vinyl monomer is preferably used as the polymerizable monomer that can produce the binder resin. A monofunctional monomer or multifunctional monomer may be used as this vinyl monomer.

The monofunctional monomer can be exemplified by styrene; styrene derivatives such as α-methylstyrene, β-methylstyrene, o-methylstyrene, m-methylstyrene, p-methylstyrene, p-methoxystyrene, and p-phenylstyrene; acrylic polymerizable monomers such as methyl acrylate, ethyl acrylate, n-propyl acrylate, isopropyl acrylate, n-butyl acrylate, dibutyl phosphate ethyl acrylate, and 2-benzoyloxyethyl acrylate; methacrylic polymerizable monomers such as methyl methacrylate, ethyl methacrylate, and dibutyl phosphate ethyl methacrylate; methylene aliphatic monocarboxylic acid esters; vinyl esters such as vinyl acetate and vinyl propionate; vinyl ethers such as vinyl methyl ether, vinyl ethyl ether, and vinyl isobutyl ether; and vinyl ketones such as vinyl methyl ketone, vinyl hexyl ketone, and vinyl isopropyl ketone.

The polymerizable monomer preferably contains, among the preceding, styrene or a styrene derivative.

The multifunctional monomer can be exemplified by diethylene glycol diacrylate, triethylene glycol diacrylate, tetraethylene glycol diacrylate, polyethylene glycol diacrylate, tetramethylolmethane tetramethacrylate, divinylbenzene, and divinyl ether.

A single one of these monofunctional monomers may be used by itself or two or more may be used in combination, or a combination of the aforementioned monofunctional monomer and multifunctional monomer may be used.

The use of a crosslinking agent for the polymerizable monomer is preferred. This crosslinking agent preferably has an ether structure. The following crosslinking agents are specific examples, but there is no limitation to these:

polyethylene glycol #200 diacrylate (A200), polyethylene glycol #400 diacrylate (A400), polyethylene glycol #600 diacrylate (A600), polyethylene glycol #1000 diacrylate (A1000), dipropylene glycol diacrylate (APG100), tripropylene glycol diacrylate (APG200), polypropylene glycol #400 diacrylate (APG400), polypropylene glycol #700 diacrylate (APG700), and polytetrapropylene glycol #650 diacrylate (A-PTMG-65) (all from Shin-Nakamura Chemical Co., Ltd.).

Among the preceding, those having the structure given in formula (4) are more preferred. Specifically, tripropylene glycol diacrylate (APG200), polypropylene glycol #400 diacrylate (APG400), and polypropylene glycol #700 diacrylate (APG700) are more preferred, although there is no limitation to these.

The amount of addition of the crosslinking agent, per 100.0 mass parts of the binder resin or polymerizable monomer that can produce the binder resin, is preferably from 0.01 mass parts to 5.00 mass parts and is more preferably from 0.10 mass parts to 3.00 mass parts.

A polymerization initiator may be used in toner particle production. For example, an oil-soluble initiator or a water-soluble initiator may be used for the polymerization initiator. A polymerization initiator is preferred that has a half-life of from 0.5 hours to 30 hours at the reaction temperature of the polymerization reaction. Execution of the polymerization reaction using the addition of from 0.5 mass parts to 20 mass parts per 100 mass parts of the polymerizable monomer is preferred because generally this can provide a polymer having a molecular weight maximum between 10,000 and 100,000 and can provide a toner particle having a suitable strength and melting characteristics.

The polymerization initiator can be exemplified by azo and diazo polymerization initiators such as 2,2'-azobis(2,4-dimethylvaleronitrile), 2,2'-azobisisobutyronitrile, 1,1'-azobis(cyclohexane-1-carbonitrile), 2,2'-azobis-4-methoxy-2,4-dimethylvaleronitrile, and azobisisobutyronitrile, and by peroxide-type polymerization initiators such as benzoyl peroxide, t-butyl peroxy-2-hexanoate, t-butyl peroxypivalate, t-butyl peroxyisobutyrate, t-butyl peroxyneodecanoate, methyl ethyl ketone peroxide, diisopropyl peroxycarbonate, cumene hydroperoxide, 2,4-dichlorobenzoyl peroxide, and lauroyl peroxide.

Known chain transfer agents, polymerization inhibitors, and so forth may also be used in order to control the degree of polymerization for the polymerizable monomer.

The polymerizable monomer composition may contain a polyester resin.

Examples of the constituent components of this polyester resin are provided in the following.

The divalent acid component can be exemplified by the following dicarboxylic acids and derivatives thereof: benzenedicarboxylic acids and their anhydrides and lower alkyl esters, e.g., phthalic acid, terephthalic acid, isophthalic acid, and phthalic anhydride; alkyldicarboxylic acids, e.g., succinic acid, adipic acid, sebacic acid, and azelaic acid, and their anhydrides and lower alkyl esters; alkenylsuccinic acids and alkylsuccinic acids, e.g., n-dodecenylsuccinic acid and n-dodecylsuccinic acid, and their anhydrides and lower alkyl esters; and unsaturated dicarboxylic acids, e.g., fumaric acid, maleic acid, citraconic acid, and itaconic acid, and their anhydrides and lower alkyl esters.

The divalent alcohol component can be exemplified by the following: ethylene glycol, polyethylene glycol, 1,2-propanediol, 1,3-propanediol, 1,6-hexanediol, neopentyl glycol, 1,4-cyclohexanedimethanol (CHDM), hydrogenated bisphenol A, and bisphenol and derivatives thereof.

In addition to the aforementioned divalent carboxylic acid compound and divalent alcohol compound, the polyester resin may also contain the following as a constituent component: a monovalent carboxylic acid compound, a monovalent alcohol compound, an at least trivalent carboxylic acid compound, and an at least trivalent alcohol compound.

The monovalent carboxylic acid compound can be exemplified by benzoic acid; aromatic carboxylic acids having not more than 30 carbons, e.g., p-methylbenzoic acid; and aliphatic carboxylic acids having not more than 30 carbons, e.g., stearic acid and behenic acid.

The monovalent alcohol compound can be exemplified by aromatic alcohols having not more than 30 carbons, e.g., benzyl alcohol, and by aliphatic alcohols having not more than 30 carbons, e.g., lauryl alcohol, cetyl alcohol, stearyl alcohol, and behenyl alcohol.

The at least trivalent carboxylic acid compound is not particularly limited and can be exemplified by trimellitic acid, trimellitic anhydride, and pyromellitic acid.

The at least trivalent alcohol compound can be exemplified by trimethylolpropane, pentaerythritol, and glycerol.

The method for producing the polyester resin is not particularly limited, and a known method may be used.

The amount of addition or content of the polyester resin is preferably from 0.05 mass parts to 20.0 mass parts per 100.0 mass parts of the binder resin or polymerizable monomer that can produce the binder resin.

As noted above, the crystalline material preferably contains an ester wax. This ester wax is specifically exemplified by behenyl stearate, ethylene glycol dibehenate, ethylene glycol distearate, ethylene glycol arachidinate stearate, ethylene glycol stearate palmitate, butylene glycol distearate, butylene glycol arachidinate stearate, butylene glycol stearate palmitate, and butylene glycol dibehenate. Difunctional ester waxes are more preferred among the preceding.

The amount of addition or content of the ester wax, per 100.0 mass parts of the binder resin or polymerizable monomer that can produce the binder resin, is preferably from 1.0 mass part to 50.0 mass parts and is more preferably from 10.0 mass parts to 35.0 mass parts.

The content of this ester wax in the crystalline material is preferably greater than 50.0 mass % and less than or equal to 100.0 mass %. This content is more preferably from 75.0 mass % to 100.0 mass %.

The melting point of this ester wax is preferably from 60° C. to 90° C. The melting point of the ester wax is the peak temperature of the maximum endothermic peak in measurement of the ester wax using differential scanning calorimetry.

A hydrocarbon wax, e.g., a low molecular weight polyethylene, low molecular weight polypropylene, microcrystalline wax, paraffin wax, and so forth, may also be co-used in order to improve the releasability. The following are specific examples of this hydrocarbon wax:

Viscol (registered trademark) 330-P, 550-P, 660-P, and TS-200 (Sanyo Chemical Industries, Ltd.); Hi-WAX 400P, 200P, 100P, 410P, 420P, 320P, 220P, 210P, and 110P (Mitsui Chemicals, Inc.); Sasol H1, H2, C80, C105, and C77 (Schumann Sasol GmbH); HNP-1, HNP-3, HNP-9, HNP-10, HNP-11, HNP-12, and HNP-51 (Nippon Seiro Co., Ltd.); and UNILIN (registered trademark) 350, 425, 550, and 700 and UNICID (registered trademark) and UNICID (registered trademark) 350, 425, 550, and 700 (Toyo ADL Corporation).

The amount of addition or content of the hydrocarbon wax, per 100.0 mass parts of the binder resin or polymerizable monomer that can produce the binder resin, is preferably from 0.1 mass parts to 20 mass parts and is more preferably from 1.0 mass part to 10 mass parts.

The toner may be a toner that has a toner particle that has a shell portion in addition to a core portion. The resin forming the shell portion can be exemplified by resins such as polyester resins, styrene-acrylic copolymers, and styrene-methacrylic copolymers, with polyester resins being preferred. The same polyester resins as described above may be used for this polyester resin.

The toner particle may contain a colorant. For example, carbon black and the yellow colorants, magenta colorants, and cyan colorants described below may be used as the colorant.

Yellow colorants can be exemplified by compounds as typified by condensed azo compounds, isoindolinone compounds, anthraquinone compounds, azo-metal complexes, methine compounds, and allylamide compounds. Specific examples are C.I. Pigment Yellow 12, 13, 14, 15, 17, 62, 73, 74, 83, 93, 94, 95, 97, 109, 110, 111, 120, 128, 129, 138, 147, 150, 151, 154, 155, 168, 180, 185, and 214.

The following are examples of magenta colorants: condensed azo compounds, diketopyrrolopyrrole compounds, anthraquinone compounds, quinacridone compounds, basic dye lake compounds, naphthol compounds, benzimidazolone compounds, thioindigo compounds, and perylene compounds. Specific examples are C.I. Pigment Red 2, 3, 5, 6, 7, 23, 48:2, 48:3, 48:4, 57:1, 81:1, 122, 146, 166, 169, 177, 184, 185, 202, 206, 220, 221, 238, 254, and 269 and C.I. Pigment Violet 19.

The cyan colorants can be exemplified by copper phthalocyanine compounds and derivatives thereof, anthraquinone compounds, and basic dye lake compounds. Specific examples are C.I. Pigment Blue 1, 7, 15, 15:1, 15:2, 15:3, 15:4, 60, 62, and 66.

A single one of these colorants may be used by itself or a mixture of two or more may be used, and the colorants may be used in the form of a solid solution.

In addition, the toner may also be a magnetic toner in which a magnetic body is incorporated as a colorant in the toner particle. The magnetic body is a magnetic body in which the major component is a magnetic iron oxide such as triiron tetroxide or γ-iron oxide, and may contain an element such as phosphorus, cobalt, nickel, copper, magnesium, manganese, aluminum, or silicon. This magnetic body has a BET specific surface area by nitrogen adsorption of preferably from 2 $m^2/g$ to 30 $m^2/g$ and more preferably from 3 $m^2/g$ to 28 $m^2/g$. A magnetic body with a Mohs hardness of from 5 to 7 is preferred. The shape of the magnetic body may be, for example, polyhedral, octahedral, hexahedral, spherical, acicular, flake, and so forth; however, low-anisotropy shapes, e.g., polyhedral, octahedral, hexahedral, and spherical, are preferred from the standpoint of increasing the image density.

The number-average particle diameter of the magnetic body is preferably from 0.10 μm to 0.40 μm. Generally, a smaller particle diameter for the magnetic body, while raising the tinting strength, facilitates aggregation of the magnetic body, and the indicated range is thus preferred from the standpoint of balancing the tinting strength with the aggregation behavior.

The number-average particle diameter of the magnetic body can be measured using a transmission electron microscope. Specifically, the toner particles to be observed are thoroughly dispersed in an epoxy resin, and a cured material is then obtained by curing for 2 days in an atmosphere with a temperature of 40° C. The obtained cured material is converted into a thin-section sample using a microtome, and, using a photograph at a magnification of 10,000× to 40,000× taken with a transmission electron microscope (TEM), the particle diameter of 100 magnetic bodies in the field of observation is measured. The number-average particle diameter is calculated based on the equivalent diameter of the circle equal to the projected area of the magnetic body. The particle diameter may also be measured using an image processing instrument.

The magnetic body can be produced, for example, using the following method.

An alkali, e.g., sodium hydroxide, is added, in at least an equivalent amount with reference to the iron component, to an aqueous solution of a ferrous salt to prepare an aqueous solution containing ferrous hydroxide. Air is blown in while keeping the pH of the prepared aqueous solution at 7 or above, and an oxidation reaction is carried out on the ferrous hydroxide while heating the aqueous solution to at least 70° C. to first produce seed crystals that will form the core of the magnetic iron oxide particles.

An aqueous solution containing ferrous sulfate is then added, at approximately 1 equivalent based on the amount of addition of the previously added alkali, to the seed crystal-containing slurry. While maintaining the pH of the liquid at 5 to 10 and blowing in air, the reaction of the ferrous hydroxide is developed in order to grow magnetic iron oxide particles using the seed crystals as cores. At this point, the shape and magnetic properties of the magnetic body can be controlled by free selection of the pH, reaction temperature, and stirring conditions. The pH of the liquid transitions to the acidic side as the oxidation reaction progresses, but the pH of the liquid preferably does not drop below 5. The thusly obtained magnetic body is filtered, washed, and dried by standard methods to obtain the magnetic body.

In addition, when the toner particle is produced in an aqueous medium, a hydrophobic treatment is preferably carried out on the magnetic body surface. When the surface treatment of the magnetic body is carried out by a dry method, treatment with a coupling agent can be carried out on the magnetic body that has been washed, filtered, and dried. When the surface treatment of the magnetic body is carried out by a wet method, the coupling treatment may be carried out with redispersion of the material that has been dried after the completion of the oxidation reaction, or with redispersion, in a separate aqueous medium without drying, of the iron oxide obtained by washing and filtration after completion of the oxidation reaction. A dry method or a wet method may be selected as appropriate in the present disclosure.

A coupling agent can be used for the surface treatment of the magnetic body. These coupling agents can be exemplified by silane coupling agents, titanium coupling agents, and so forth. A silane coupling agent is more preferably used and is represented by the following formula (5).

$$R_mSiY_n \quad (5)$$

In the formula, R represents an alkoxy group; m represents an integer from 1 to 3; Y represents a functional group such as an alkyl group, vinyl group, epoxy group, (meth) acryl group, and so forth; and n represents an integer from 1 to 3; with the proviso that m+n=4.

Y in formula (5) is preferably an alkyl group. Y is more preferably an alkyl group having from 3 to 16 carbons and still more preferably from 3 to 10 carbons.

When such a silane coupling agent is used, the treatment may be carried out using a single silane coupling agent by itself or may be carried out using a plurality of silane coupling agents in combination. When a plurality of silane coupling agents are used in combination, a separate treatment may be carried out with each coupling agent or treatment may be carried out with all at the same time.

The total amount of treatment with the coupling agent that is employed is preferably 0.9 mass parts to 3.0 mass parts per 100.0 mass parts of the magnetic body. The amount of use of the coupling agent may be adjusted as appropriate in conformity to, for example, the surface area of the magnetic body, the reactivity of the coupling agent, and so forth.

The colorant is selected based on such considerations as the hue angle, chroma, lightness, lightfastness, OHP transparency, dispersibility in the toner, and so forth. The amount of addition or content of the colorant, per 100.0 mass parts of the binder resin or polymerizable monomer that can produce the binder resin, is preferably from 1.0 mass part to 95.0 mass parts and more preferably from 1.0 mass part to 90.0 mass parts.

In addition to the materials described in the preceding, the following may be added to the toner particle without impairing the effects of the present disclosure: a known functional resin, known charge control agent, known conductivity-imparting agent, known lubricant, known abrasive, and so forth.

The method for producing the toner particle using suspension polymerization can have a dissolution step of uniformly dissolving or dispersing these additives to provide a polymerizable monomer composition, and a granulation step of dispersing and granulating, using a suitable stirrer, this polymerizable monomer composition in an aqueous medium that contains a dispersion stabilizer. This production method may have the following on an optional basis: a polymerization reaction step of adding a polymerization initiator and carrying out a polymerization reaction; a cooling step of adjusting the size and location of occurrence of the crystalline material microdomains; and/or a holding (annealing) step of controlling the degree of crystallinity of the crystalline material.

The use of this cooling step and holding (annealing) step is preferred from the standpoint of enhancing the effects described in the preceding.

The use is preferred of an increased cooling rate from the temperature at the completion of the reaction step until the drop to the temperature after cooling has been achieved. Specifically, the cooling rate is preferably from 50° C./min to 350° C./min and is more preferably from 100° C./min to 300° C./min.

In addition, the cooling start temperature for the cooling step is preferably from 70° C. to 100° C. The annealing temperature in the holding (annealing) step is preferably from 45° C. to 65° C.

The toner can be obtained by subjecting the thusly obtained toner particle to filtration, washing, and drying using known methods and optionally admixing inorganic fine particles, as a flowability improver, to attach same to the toner particle surface.

Known inorganic fine particles can be used as these inorganic fine particles. The inorganic fine particles are preferably titania fine particles; silica fine particles such as silica produced by a wet method, silica produced by a dry method, and so forth; or inorganic fine particles provided by carrying out a surface treatment on such a silica using, for example, a silane coupling agent, a titanium coupling agent, or silicone oil. The surface-treated inorganic fine particles preferably have a hydrophobicity, as determined by methanol titration testing, of from 30 to 98.

The methods used to measure the properties pertaining to the toner particle and toner are given in the following. The property values in the examples, infra, were also measured using these methods.

Method for Measuring the Powder Dynamic Viscoelasticity of the Toner

The measurement is carried out using a DMA 8000 (PerkinElmer Inc.) dynamic viscoelastic measurement instrument.

measurement tool: Material Pocket (P/N: N533-0322)

80 mg of the toner is sandwiched in the Material Pocket; this is installed in the single cantilever; and attachment is carried out by tightening the screw with a torque wrench.

The "DMA Control Software" (PerkinElmer Inc.) dedicated software is used for the measurement. The measurement conditions are as follows.

oven: Standard Air Oven
measurement type: temperature scan
DMA condition: single frequency/strain (G)
frequency: 1 Hz
strain: 0.05 mm
start temperature: 25° C.
completion temperature: 180° C.
scan rate: 20° C./min or 5° C./min
deformation mode: single cantilever (B)
cross section: rectangle (R)
test specimen size (length): 17.5 mm
test specimen size (width): 7.5 mm
test specimen size (thickness): 1.5 mm The onset temperatures T(A) and T(B) (unit: ° C. in both cases) are determined from the curve yielded by this measurement of the storage elastic modulus E'. T(A) and T(B) are the temperatures corresponding to the intersection between the straight line provided by extending the baseline on the low-temperature side of the E' curve to the high-temperature side, and the tangent drawn at the point at which the slope of the E' curve assumes a maximum.

The storage elastic modulus E' at 100° C. in measurement at the scan rate of 20° C./min is used for EA'(100).

Method for Calculating the Number and Major Diameter of the Domains of the Crystalline Material The toner cross section for observation with a transmission electron microscope (TEM) is prepared proceeding as follows.

The toner is embedded using a visible light-curable embedding resin (D-800, Nisshin EM Co., Ltd.); sectioning at a thickness of 60 nm is performed using an ultrasound ultramicrotome (EMS, Leica); and ruthenium staining is performed using a vacuum staining instrument (Filgen, Inc).

The resulting toner cross section is then observed using a transmission electron microscope (H7500, Hitachi High-Technologies Corporation) and an acceleration voltage of 120 kV.

Of the observed toner cross sections, 100 of those within ±2.0 μm of the number-average particle diameter of the toner are randomly selected and are photographed to obtain cross-sectional images.

The crystalline material in the ruthenium-stained toner is resistant to this staining and the crystalline material domains therefore appear white under TEM observation. The crystalline material domains in the cross-sectional image can be discriminated on this basis. To determine the number and major diameter of these domains, the major diameter is measured on all the domains in the cross-sectional image, and the number of domains having a major diameter in the range from 20 nm to 300 nm is determined.

The number of domains having a major diameter in the range from 20 nm to 300 nm is determined for all 100 of the acquired toner cross-sectional images, and the average value for this is used in the present disclosure as the number of domains of the crystalline material that have a major diameter of from 20 nm to 300 nm.

Measurement of the Peak Temperature of the Maximum Endothermic Peak of the Toner and Ester Wax The peak temperature of the maximum endothermic peak of the toner and ester wax are measured using differential scanning calorimetry (DSC). A Q2000 from TA Instruments is used for the measurement. The measurement conditions are as follows.

ramp rate: 10° C./min
measurement start temperature: 20° C.
measurement end temperature: 180° C.

The melting points of indium and zinc are used for temperature correction in the instrument detection section, and the heat of fusion of indium is used for correction of the amount of heat.

Specifically, 5 mg of the toner or ester wax is exactly weighed and introduced into an aluminum pan and a single measurement is run. The measurement is run with the installation of an empty aluminum pan for reference.

Identification of the Crystalline Material Domains

Identification of the crystalline material domains is carried out in accordance with the following procedure based on the TEM image of the toner particle cross section.

When crystalline materials can be acquired in raw material form, the crystalline structures thereof are observed proceeding as in the above-described method for observing the ruthenium-stained toner particle cross section using a transmission electron microscope (TEM) and the lamellar structure of the crystals in each raw material is imaged. These are compared with the lamellar structure in the domains of the toner particle cross section, and the raw material forming the domains in the toner particle cross section can be identified when the error for the layer distance of the lamellae is not greater than 10%.

Isolation of the Crystalline Material

An isolation procedure is carried out as follows when the raw material for the crystalline material cannot be acquired.

First, the toner is dispersed in ethanol, which is a poor solvent for the toner, and heating is carried out to a temperature that exceeds the melting point of the crystalline material. Pressure may be applied at this point as necessary. The crystalline material above the melting point melts at this point.

A mixture containing the crystalline material can then be recovered from the toner by solid-liquid separation. The crystalline material can be isolated by fractionating this mixture into individual molecular weights.

Method for Measuring the Molecular Weight of the Crystalline Material

The molecular weight of the crystalline material is measured using gel permeation chromatography (GPC) as follows.

First, the crystalline material is dissolved in tetrahydrofuran (THF) at room temperature. The obtained solution is filtered using a "Sample Pretreatment Cartridge" (Tosoh Corporation) solvent-resistant membrane filter having a pore diameter of 0.2 μm to obtain a sample solution. The sample solution is adjusted to a concentration of THF-soluble component of 0.8 mass %. Measurement is carried out under the following conditions using this sample solution.

instrument: "HLC-8220GPC" high-performance GPC instrument [Tosoh Corporation]
column: 2×LF-604
eluent: THF
flow rate: 0.6 mL/min
oven temperature: 40° C.
sample injection amount: 0.020 mL A molecular weight calibration curve constructed using polystyrene resin standards (product name "TSK Standard Polystyrene F-850, F-450, F-288, F-128, F-80, F-40, F-20, F-10, F-4, F-2, F-1, A-5000, A-2500, A-1000, A-500", Tosoh Corporation) is used to determine the molecular weight of the sample.

Method for Measuring the Weight-Average Particle Diameter (D4) and the Number-Average Particle Diameter (D1) of the Toner The weight-average particle diameter (D4) and the number-average particle diameter (D1) of the toner are determined as follows.

The measurement instrument used is a "Coulter Counter Multisizer 3" (registered trademark, Beckman Coulter, Inc.), a precision particle size distribution measurement instrument operating on the pore electrical resistance method and equipped with a 100-μm aperture tube. The measurement conditions are set and the measurement data are analyzed using the accompanying dedicated software, i.e., "Beckman Coulter Multisizer 3 Version 3.51" (Beckman Coulter, Inc.). The measurements are carried out in 25,000 channels for the number of effective measurement channels.

The aqueous electrolyte solution used for the measurements is prepared by dissolving special-grade sodium chloride in deionized water to provide a concentration of approximately 1 mass %, and specifically "ISOTON II" (Beckman Coulter, Inc.) is used.

The dedicated software is configured as follows prior to measurement and analysis.

In the "modify the standard operating method (SOM)" screen in the dedicated software, the total count number in the control mode is set to 50,000 particles; the number of measurements is set to 1 time; and the Kd value is set to the value obtained using "standard particle 10.0 μm" (Beckman Coulter, Inc.). The threshold value and noise level are automatically set by pressing the "threshold value/noise level measurement" button. In addition, the current is set to 1600 μA; the gain is set to 2; the electrolyte solution is set to ISOTON II; and a check is entered for the "post-measurement aperture tube flush".

In the "setting conversion from pulses to particle diameter" screen of the dedicated software, the bin interval is set to logarithmic particle diameter; the particle diameter bin is set to 256 particle diameter bins; and the particle diameter range is set to from 2 μm to 60 μm.

The specific measurement procedure is as follows.

1. Approximately 200 mL of the above-described aqueous electrolyte solution is introduced into a 250-mL roundbottom glass beaker intended for use with the Multisizer 3 and this is placed in the sample stand and counterclockwise stirring with the stirrer rod is carried out at 24 rotations per second. Contamination and air bubbles within the aperture tube are preliminarily removed by the "aperture tube flush" function of the dedicated software.
2. Approximately 30 mL of the aqueous electrolyte solution is introduced into a 100-mL flatbottom glass beaker. To this is added as dispersing agent approximately 0.3 mL of a diluted solution prepared by the three-fold (mass) dilution with deionized water of "Contaminon N" (a 10 mass % aqueous solution of a neutral pH 7 detergent for cleaning precision measurement instrumentation, composed of a nonionic surfactant, anionic surfactant, and organic builder, from Wako Pure Chemical Industries, Ltd.).
3. An "Ultrasonic Dispersion System Tetora 150" (Nikkaki Bios Co., Ltd.) is prepared; this is an ultrasound disperser with an electrical output of 120 W and is equipped with two oscillators (oscillation frequency=50 kHz) disposed such that the phases are displaced by 180°. Approximately 3.3 L of deionized water is introduced into the water tank of the ultrasound disperser and approximately 2 mL of Contaminon N is added to this water tank.
4. The beaker described in 2. is set into the beaker holder opening on the ultrasound disperser and the ultrasound disperser is started. The vertical position of the beaker is adjusted in such a manner that the resonance condition of the surface of the aqueous electrolyte solution within the beaker is at a maximum.
5. While the aqueous electrolyte solution within the beaker set up according to 4. is being irradiated with ultrasound, approximately 10 mg of the toner is added to the aqueous electrolyte solution in small aliquots and dispersion is carried out. The ultrasound dispersion treatment is continued for an additional 60 seconds. The water temperature in the water tank is controlled as appropriate during ultrasound dispersion to be from 10° C. to 40° C.
6. Using a pipette, the dispersed toner-containing aqueous electrolyte solution prepared in 5. is dripped into the roundbottom beaker set in the sample stand as described in 1. with adjustment to provide a measurement concentration of approximately 5%. Measurement is then performed until the number of measured particles reaches 50,000.
7. The measurement data is analyzed by the dedicated software provided with the instrument and the weight-average particle diameter (D4) and the number-average particle diameter (D1) are calculated. When set to graph/number % with the dedicated software, the "average diameter" on the "analysis/numerical statistical value (arithmetic average)" screen is the number-average particle diameter (D1). When set to graph/volume % with the dedicated software, the "average diameter" on the analysis/volume statistical value (arithmetic average) screen is the weight-average particle diameter (D4).

Method for Measuring the Content of Tetrahydrofuran (THF)-Insoluble Matter 1.5 g of the toner is exactly weighed and is introduced into an extraction thimble (product name: No. 86R, size 28×100 mm, Advantec Toyo Kaisha, Ltd.) that has previously been exactly weighed, and this is set into a Soxhlet extractor.

Extraction is carried out for 20 hours using 200 mL of tetrahydrofuran as solvent, during which time the extraction is run at a reflux rate that provides an extraction solvent cycle of once in approximately 5 minutes.

After the completion of the extraction, the thimble is removed and is air dried, followed by vacuum drying for 8 hours at 40° C.; the mass of the thimble containing the extraction residue is weighed and the mass of the thimble is subtracted to determine the mass of the extraction residue W1 (g).

The content W2 (g) of the components other than the resin component is determined using the following procedure.

1.5 g of the toner is exactly weighed into a pre-weighed 30-mL porcelain crucible.

The porcelain crucible is placed in an electric furnace and is heated for about three hours at approximately 900° C. and is then left to cool in the electric furnace and is left to cool for at least one hour in a desiccator at normal temperature. The mass of the crucible containing the ignition residue is weighed, and the mass of the ignition residue is calculated by subtracting the mass of the crucible and this is used as W2 (g).

The content of the THF-insoluble matter derived from the binder resin is determined using these values and the following formula.

$$\text{content (mass \%) of THF-insoluble matter derived from the binder resin} = (W1 - W2)/(1.5 - W2) \times 100$$

EXAMPLES

The present disclosure is described in additional detail in the following using examples and comparative examples; however, the present disclosure is in no way limited thereby. The number of parts in the examples and comparative examples is on a mass basis unless specifically indicated otherwise.

Production of WAX1

100 parts of stearic acid and 10 parts of ethylene glycol were added to a reactor fitted with a nitrogen introduction line, water separation tube, stirrer, and thermocouple and a reaction was run for 15 hours under normal pressure and a nitrogen current at 180° C. while distilling out the water produced by the reaction. The crude esterification product was water-washed by adding 20 parts toluene and 4 parts ethanol per 100 parts of the crude esterification product provided by this reaction and, after stirring, allowing the crude esterification product stand for 30 minutes and then removing the aqueous phase (lower layer) that had separated from the ester phase. This water wash was performed four times, until the pH of the aqueous phase had reached 7. The solvent was then distilled from the water-washed ester phase at 170° C. under a reduced pressure condition of 5 kPa to obtain WAX1. The melting point of WAX1 was 76° C.

Production of WAX2

WAX2 was obtained by carrying out the same procedure as in the Production of WAX1, but changing the acid monomer from stearic acid to behenic acid. The melting point of WAX2 was 83° C.

Production of WAX3

WAX3 was obtained by carrying out the same procedure as in the Production of WAX1, but changing the alcohol monomer from ethylene glycol to behenyl alcohol. The melting point of WAX3 was 74° C.

Crystalline Polyester Resin 1 Production 100.0 parts of sebacic acid as acid monomer 1, 1.6 parts of stearic acid as acid monomer 2, and 89.3 parts of 1,9-nonanediol as the alcohol monomer were introduced into a reactor fitted with a nitrogen introduction line, water separation tube, stirrer, and thermocouple. The temperature was raised to 140° C. while stirring and a reaction was run for 8 hours while heating to 140° C. under a nitrogen atmosphere and distilling out the water under reduced pressure.

0.57 parts of tin dioctylate was then added, followed by reaction while heating to 200° C. at 10° C./hour. After reaction for 2 hours after 200° C. had been reached, the pressure in the reactor was lowered to 5 kPa or below and the reaction was run at 200° C. while monitoring the molecular weight to obtain crystalline polyester resin 1. Analysis of the obtained crystalline polyester resin 1 gave a weight-average molecular weight of 38,000.

Crystalline Polyester Resin 2 Production

A crystalline polyester resin 2 was obtained by carrying out production by the same steps as in Crystalline Polyester Resin 1 Production, but using 1,12-dodecanediol as the alcohol monomer. Analysis of the obtained crystalline polyester resin 2 gave a weight-average molecular weight of 40,000.

Magnetic Iron Oxide Production Example 55 liters of a 4.0 mol/L aqueous sodium hydroxide solution was mixed with stirring into 50 liters of an aqueous ferrous sulfate solution containing $Fe^{2+}$ at 2.0 mol/L to obtain an aqueous ferrous salt solution that contained colloidal ferrous hydroxide. An oxidation reaction was run while holding this aqueous solution at 85° C. and blowing in air at 20 L/min to obtain a slurry that contained core particles.

The obtained slurry was filtered and washed on a filter press, after which the core particles were reslurried by redispersion in water. To this reslurry liquid, sodium silicate was added to provide 0.20 mass % as silicon per 100 parts of the core particles; the pH of the slurry was adjusted to 6.0; and magnetic iron oxide particles having a silicon-rich surface were obtained by stirring. The obtained slurry was filtered and washed with a filter press and was reslurried with deionized water.

Into this reslurry liquid (solids fraction=50 g/L) was introduced 500 g (10 mass % relative to the magnetic iron oxide) of the ion-exchange resin SK110 (Mitsubishi Chemical Corporation) and ion-exchange was carried out for 2 hours with stirring. This was followed by removal of the ion-exchange resin by filtration on a mesh; filtration and washing on a filter press; and drying and crushing to obtain a magnetic iron oxide having a number-average particle diameter of 0.23 μm.

Silane Compound Production 30 parts of isobutyltrimethoxysilane was added dropwise while stirring into 70 parts of deionized water. This aqueous solution was then held at a pH of 5.5 and a temperature of 55° C. and a hydrolysis was run by dispersing for 120 minutes at a peripheral velocity of 0.46 m/s using a disper impeller. The hydrolysis reaction was then stopped by bringing the pH of the aqueous solution to 7.0 and cooling to 10° C. This yielded a silane compound-containing aqueous solution.

Magnetic Body 1 Production 100 parts of the aforementioned magnetic iron oxide was introduced into a high-speed mixer (Model LFS-2 from Fukae Powtec Corporation) and 8.0 parts of the silane compound-containing aqueous solution was added dropwise over 2 minutes while stirring at a rotation rate of 2,000 rpm. This was followed by mixing and stirring for 5 minutes. Then, in order to raise the adherence of the silane compound, drying was carried out for 1 hour at 40° C. and, after the moisture had been reduced, the mixture was dried for 3 hours at 110° C. to develop the condensation reaction of the silane compound. This was followed by crushing and passage through a screen having an aperture of 100 μm to obtain a magnetic body 1.

Amorphous Polyester Resin 1 Production Example 40 mol % terephthalic acid, 10 mol % trimellitic acid, and 50 mol % bisphenol A/2 mol propylene oxide adduct were introduced into a reactor fitted with a nitrogen introduction line, water separation tube, stirrer, and thermocouple, followed by the addition, as catalyst, of 1.5 parts of dibutyltin per 100 parts of the total amount of monomer.

Then, after rapidly heating to 180° C. at normal pressure under a nitrogen atmosphere, a polycondensation was run while distilling off the water while heating from 180° C. to 210° C. at a rate of 10° C./hour. After 210° C. had been reached, the pressure in the reactor was reduced to 5 kPa or below and a polycondensation was run at 210° C. at a pressure condition of 5 kPa or below to obtain amorphous polyester resin 1. In this process, the polymerization time was adjusted so the softening point of the obtained amorphous polyester resin 1 was 120° C.

Toner 1 Production Example

A toner particle and toner were produced using the following procedure.

An aqueous medium containing a dispersion stabilizer was obtained by introducing 450 parts of a 0.1 mol/L aqueous $Na_3PO_4$ solution into 720 parts of deionized water and heating to 60° C. and then adding 67.7 parts of a 1.0 mol/L aqueous $CaCl_2$ solution.

Preparation of a Polymerizable Monomer Composition

| | |
|---|---|
| styrene | 72.0 parts |
| n-butyl acrylate | 28.0 parts |
| polypropylene glycol #400 diacrylate (APG400) | 2.0 parts |
| magnetic body 1 | 65.0 parts |
| amorphous polyester resin 1 | 4.0 parts |

These materials were dispersed and mixed to uniformity using an attritor (Mitsui Miike Chemical Engineering Machinery Co., Ltd.) and then heated to 60° C.; to this was added 20.0 parts of WAX1 as an ester wax and 3.0 parts of a paraffin wax (HNP-51, Nippon Seiro Co., Ltd.) as a hydrocarbon wax with mixing and dissolution to obtain a polymerizable monomer composition.

This monomer composition was introduced into the aforementioned aqueous medium, and granulation was carried out by stirring for 10 minutes at 12,000 rpm with a T. K. Homomixer (Tokushu Kika Kogyo Co., Ltd.) at 60° C. under an $N_2$ atmosphere. Then, while stirring with a paddle impeller, 8.0 parts of the polymerization initiator t-butyl peroxypivalate was introduced, the temperature was raised to 74° C., and a reaction was run for 3 hours.

After the completion of the reaction, the temperature of the suspension was raised to 100° C. and holding was carried out for 2 hours. This was followed by a cooling step in which water at 0° C. was introduced into the suspension and the suspension was cooled from 98° C. to 30° C. at a rate of 200° C./min; this was followed by holding for 3 hours at 55° C. Cooling was then carried out to 25° C. by spontaneous cooling at room temperature. The cooling rate at this time was 2° C./minute. Hydrochloric acid was added to the suspension, which was thoroughly washed to dissolve the dispersion stabilizer, and filtration and drying then yielded a toner particle 1 having a weight-average particle diameter of 7.3 μm.

The following materials were admixed using a Henschel mixer (Model FM-10, Mitsui Miike Chemical Engineering Machinery Co., Ltd.) per 100 parts of the obtained toner particle 1 to obtain a toner 1.

hydrophobic silica fine particles having a number-average primary particle diameter of 20 nm, surface-treated with 25 mass % hexamethyldisilazane 0.5 parts hydrophobic silica fine particles having a number-average primary particle diameter of 40 nm, surface-treated with 15 mass % hexamethyldisilazane 0.5 parts The properties of the obtained toner 1 are given in Table 1.

Toners 2 to 15 Production Example

Toners 2 to 15 were obtained proceeding as in the Toner 1 Production Example, but using the material constituents and production conditions shown in Table 2 for the styrene (given as St in Table 2), n-butyl acrylate (given as BA in Table 2), ester wax, crosslinking agent, and post-reaction-completion cooling rate in the Toner 1 Production Example (in Table 2, St/BA=72/28 indicates that 72.0 parts of styrene and 28.0 parts of BA were used). The properties of the obtained toners are given in Table 1.

Toners 16 to 19 Production Example

Toners 16 to 19 were obtained proceeding as in the Toner 1 Production Example, but using the material constituents and production conditions shown in Table 2 for the styrene, n-butyl acrylate, ester wax, hydrocarbon wax, crystalline polyester 1, and crosslinking agent in the Toner 1 Production Example. The properties of the obtained toners are given in Table 1.

Toner 20 Production Example

The following materials were introduced into an attritor (Mitsui Miike Chemical Engineering Machinery Co., Ltd.), and a pigment masterbatch was prepared by carrying out dispersion for 5 hours at 220 rpm using zirconia particles having a diameter of 1.7 mm.

| | |
|---|---|
| styrene | 60.0 parts |
| carbon black (product name: "Printex 35", Orion Engineered Carbons LLC) | 7.0 parts |
| charge control agent (Bontron E-89, Orient Chemical Industries Co., Ltd.) | 0.10 parts |

An aqueous medium containing a dispersion stabilizer was obtained by introducing 450 parts of a 0.1 mol/L aqueous $Na_3PO_4$ solution into 720 parts of deionized water and heating to 60° C. and then adding 67.7 parts of a 1.0 mol/L aqueous $CaCl_2$ solution.

Preparation of a Polymerizable Monomer Composition

| | |
|---|---|
| styrene | 12.0 parts |
| n-butyl acrylate | 28.0 parts |
| polypropylene glycol #400 diacrylate (APG400) | 2.0 parts |
| pigment masterbatch | 67.1 parts |
| amorphous polyester resin 1 | 4.0 parts |

These materials were dispersed and mixed to uniformity using an attritor (Mitsui Miike Chemical Engineering Machinery Co., Ltd.).

The ensuing steps were carried out using the same procedures as in the Toner 1 Production Example to obtain toner 20.

The properties of the obtained toner are given in Table 1.

Toner 21 Production Example

Toner 21 was obtained proceeding as in the Toner 20 Production Example, but using the material constituents and production conditions shown in Table 2 in the Toner 20 Production Example. The properties of the obtained toner are given in Table 1.

TABLE 1

| Toner No. | T(A) (° C.) | T(B) (° C.) | T(A) − T(B) (° C.) | EA'(100) ($\times 10^9$ Pa) | Average number of domains (number) | Peak temperature (° C.) | THF-insoluble matter (mass %) | Weight-average particle diameter (μm) |
|---|---|---|---|---|---|---|---|---|
| Toner 1 | 56.5 | 55.3 | 1.2 | 5.1 | 330 | 69.3 | 38 | 7.3 |
| Toner 2 | 61.5 | 59.7 | 1.8 | 5.9 | 320 | 69.7 | 80 | 7.4 |
| Toner 3 | 63.0 | 61.0 | 2.0 | 6.1 | 350 | 69.9 | 85 | 7.2 |
| Toner 4 | 64.5 | 62.3 | 2.2 | 6.5 | 335 | 70.2 | 54 | 7.1 |
| Toner 5 | 65.5 | 63.6 | 1.9 | 4.3 | 330 | 70.1 | 38 | 7.3 |
| Toner 6 | 70.0 | 67.7 | 2.3 | 4.2 | 330 | 70.8 | 31 | 7.4 |
| Toner 7 | 57.5 | 55.0 | 2.5 | 5.7 | 50 | 69.6 | 39 | 7.5 |
| Toner 8 | 59.5 | 56.8 | 2.7 | 5.9 | 35 | 70.0 | 42 | 7.3 |
| Toner 9 | 64.0 | 61.0 | 3.0 | 5.5 | 65 | 76.4 | 40 | 7.6 |
| Toner 10 | 47.5 | 46.5 | 1.0 | 4.2 | 350 | 68.9 | 20 | 7.1 |
| Toner 11 | 47.0 | 46.2 | 0.8 | 4.2 | 500 | 68.5 | 27 | 7.2 |
| Toner 12 | 51.0 | 50.2 | 0.8 | 4.5 | 380 | 69.1 | 17 | 7.5 |
| Toner 13 | 46.5 | 45.9 | 0.6 | 4.3 | 600 | 68.2 | 32 | 7.4 |
| Toner 14 | 45.0 | 44.2 | 0.8 | 4.3 | 430 | 68.4 | 28 | 7.3 |
| Toner 15 | 47.5 | 46.8 | 0.7 | 4.0 | 450 | 69.0 | 22 | 7.2 |
| Toner 16 | 64.0 | 60.4 | 3.6 | 3.7 | 250 | 67.0 | 13 | 7.2 |
| Toner 17 | 61.0 | 58.8 | 2.2 | 3.1 | 270 | 66.7 | 9 | 7.7 |
| Toner 18 | 52.0 | 50.4 | 1.6 | 2.6 | 290 | 66.5 | 7 | 7.3 |
| Toner 19 | 72.0 | 68.8 | 3.2 | 4.2 | 120 | 67.1 | 22 | 7.4 |
| Toner 20 | 56.0 | 54.9 | 1.1 | 4.9 | 330 | 66.0 | 35 | 7.0 |
| Toner 21 | 50.5 | 49.2 | 1.3 | 2.3 | 300 | 66.3 | 6 | 7.1 |

TABLE 2

| Toner No. | St/BA | Crosslinking agent Type | Amount (parts) | Ester wax Type | Amount (parts) | Hydrocarbon wax Type | Amount (parts) | Crystalline polyester resin Type | Amount (parts) | Post-reaction cooling rate (° C./min) |
|---|---|---|---|---|---|---|---|---|---|---|
| Toner 1 | 72/28 | APG400 | 2.0 | WAX1 | 20.0 | HNP-51 | 3.0 | — | — | 200 |
| Toner 2 | 72/28 | APG400 | 2.4 | WAX1 | 20.0 | HNP-51 | 3.0 | — | — | 200 |
| Toner 3 | 72/28 | APG400 | 3.0 | WAX1 | 20.0 | HNP-51 | 3.0 | — | — | 200 |
| Toner 4 | 75/25 | APG400 | 2.2 | WAX2 | 20.0 | HNP-51 | 3.0 | — | — | 200 |
| Toner 5 | 72/28 | APG200 | 2.0 | WAX1 | 20.0 | HNP-51 | 3.0 | — | — | 200 |
| Toner 6 | 72/28 | APG100 | 2.0 | WAX1 | 20.0 | HNP-51 | 3.0 | — | — | 200 |
| Toner 7 | 72/28 | APG400 | 2.0 | WAX1 | 16.0 | HNP-51 | 3.0 | — | — | 150 |
| Toner 8 | 72/28 | APG400 | 2.0 | WAX1 | 12.0 | HNP-51 | 3.0 | — | — | 100 |
| Toner 9 | 72/28 | APG400 | 2.0 | WAX2 | 16.0 | HNP-51 | 3.0 | — | — | 50 |
| Toner 10 | 72/28 | APG400 | 1.6 | WAX1 | 25.0 | HNP-51 | 3.0 | — | — | 250 |
| Toner 11 | 72/28 | APG400 | 2.0 | WAX1 | 25.0 | HNP-51 | 3.0 | — | — | 300 |
| Toner 12 | 72/28 | APG400 | 1.2 | WAX1 | 25.0 | HNP-51 | 3.0 | — | — | 250 |
| Toner 13 | 72/28 | APG400 | 2.0 | WAX1 | 25.0 | HNP-51 | 3.0 | — | — | 350 |
| Toner 14 | 68/32 | APG400 | 2.0 | WAX1 | 30.0 | HNP-51 | 3.0 | — | — | 250 |
| Toner 15 | 70/30 | APG400 | 1.6 | WAX1 | 30.0 | HNP-51 | 3.0 | — | — | 250 |
| Toner 16 | 75/25 | Divinylbenzene | 2.0 | WAX3 | 10.0 | HNP-51 | 3.0 | Crystalline polyester resin 1 | 10.0 | 200 |
| Toner 17 | 76/24 | Divinylbenzene | 2.0 | WAX1 | 10.0 | — | — | Crystalline polyester resin 2 | 10.0 | 200 |
| Toner 18 | 72/28 | Divinylbenzene | 2.0 | WAX1 | 10.0 | HNP-51 | 3.0 | Crystalline polyester resin 1 | 10.0 | 200 |
| Toner 19 | 80/20 | Divinylbenzene | 3.0 | WAX1 | 5.0 | HNP-51 | 3.0 | Crystalline polyester resin 1 | 5.0 | 200 |
| Toner 20 | 72/28 | APG400 | 2.0 | WAX1 | 20.0 | HNP-51 | 3.0 | — | — | 200 |
| Toner 21 | 72/28 | Divinylbenzene | 2.0 | WAX1 | 20.0 | HNP-51 | 3.0 | — | — | 200 |

The examples and comparative examples are described in detail in the following.

A commercial LBP-3100 (Canon, Inc.) was used as the image-forming apparatus for toners 1 to 19, while an HP LaserJet Enterprise M653x was used for toners 20 and 21. With both of these image-forming apparatuses, a modified machine, having a printing speed modified to 40 prints/minute, was used for the image output evaluations.

Example 1

The following evaluations were performed using toner 1 and the aforementioned image output evaluation machines.

(Evaluation 1) Rubbing Resistance (Low-Temperature Fixability)

The rubbing resistance was evaluated in a low-temperature, low-humidity environment (temperature of 15° C., relative humidity of 10%), which is a rigorous environment for the evaluation of the low-temperature fixability.

A4 color laser copy paper (70 g/m$^2$, Canon, Inc.) was used as the fixing media.

The evaluation procedure was as follows: after the entire fixing unit had been brought to room temperature, the density of a halftone image was adjusted to bring the image density (measured using a MacBeth reflection densitometer (MacBeth Corporation)) at a set temperature of 170° C. to 0.75 to 0.80 and 10 prints were output.

Image output was then performed at a set temperature of 150° C., and the fixed image was rubbed 10 times with lens-cleaning paper under a load of 5.4 kPa. The density reduction percentage at 150° C. was calculated using the following formula and the pre-rubbing image density and the post-rubbing image density.

density reduction percentage (%)=(pre-rubbing image density−post-rubbing image density)/pre-rubbing image density×100

Operating in the same manner, the density reduction percentage was calculated at 5° C. increments in the fixation temperature up to 200° C.

The relationship between the fixation temperature and the density reduction percentage was obtained by carrying out second-order polynomial approximation using the fixation temperature and the evaluation results for the density reduction percentage obtained from this series of operations. The temperature giving a density reduction percentage of 15% was calculated using this relationship, and this temperature was used as the fixation temperature, which represented the threshold at which the low-temperature fixability is excellent. Lower fixation temperatures indicate a better low-temperature fixability. The results of the evaluation are given in Table 3.

Evaluation Criteria

A. The fixation temperature is less than 180° C.

B. The fixation temperature is at least 180° C., but less than 190° C.

C. The fixation temperature is at least 190° C., but less than 200° C.

D. The fixation temperature is at least 200° C.

(Evaluation 2) Image Gloss Non-Uniformity During Low-Temperature Fixing (Low-Temperature Fixing Non-Uniformity)

The evaluation of the low-temperature fixing non-uniformity was carried out in a low-temperature, low-humidity environment (temperature of 15° C., relative humidity of 10%), which was regarded as a rigorous environment for the evaluation. A thick A4 paper (GF-C209, 200 g/m$^2$, Canon, Inc.) was used for the media. For the image, 10 prints of a solid image were continuously printed and the first print of which temperature is least likely to rise was used; a set temperature of 170° C. was used for the fixation temperature.

The gloss was measured using a PG-1 portable glossmeter (Nippon Denshoku Industries Co., Ltd.). The measurement was performed using 75° for both the angle of incidence and the receiving angle. For the image gloss, the gloss was measured at 10 points on the output image, and the gloss non-uniformity was evaluated using the difference between the highest gloss and the lowest gloss in these measurements. The evaluation was carried out using the following criteria. The results of the evaluation are given in Table 3.

Evaluation Criteria

A: The gloss difference is less than 3%.

B: The gloss difference is at least 3%, but less than 5%.

C: The gloss difference is at least 5%, but less than 10%.
D: The gloss difference is at least 10%.

(Evaluation 3) Image Gloss Non-Uniformity During High-Temperature Fixing (High-Temperature Fixing Non-Uniformity)

The evaluation of the high-temperature fixing non-uniformity was carried out in a high-temperature, high-humidity environment (temperature of 32° C., relative humidity of 80%), which was regarded as a rigorous environment for the evaluation. A thick A4 paper (GF-C209, 200 g/m$^2$, Canon, Inc.) was used for the media. The use of a relatively thick paper results in the paper taking in a large amount of heat from the fixing unit. This facilitates the occurrence of a large non-uniformity when the toner undergoes melt-spreading on the paper side at high temperatures, and is thus thought to enable the evaluation to be performed under more rigorous conditions. For the image, 10 prints of a solid image were continuously printed and the tenth print of which temperature is most likely to rise was used; a set temperature of 210° C. was used for the fixation temperature.

The gloss measurement and evaluation criteria were the same as in Evaluation 2. The results of the evaluation are given in Table 3.

Evaluation Criteria
A: The gloss difference is less than 3%.
B: The gloss difference is at least 3%, but less than 5%.
C: The gloss difference is at least 5%, but less than 10%.
D: The gloss difference is at least 10%.

(Evaluation 4) Hot Offset

The hot offset was evaluated in a high-temperature, high-humidity environment (temperature of 32° C., relative humidity of 80%), which was regarded as a rigorous environment for the evaluation. B5 color laser copy paper (40 g/m$^2$, Canon, Inc.) was used for the media. The use of a small-area media facilitates excessive heat retention by the fixing unit, while the use of thin paper results in a small amount of heat taken in by the paper from the fixing unit. The execution of the test in this manner facilitates the input of excess heat to the toner and provides a rigorous method for evaluating the hot offset resistance.

The evaluation procedure was as follows: after the entire fixing unit had been brought to room temperature, 10 prints of a solid image were continuously printed on the aforementioned fixing media at a set temperature of 200° C. The image on the tenth print where hot offset is most likely to occur was checked for the production of blank dots due to hot offset.

Using the same procedure and increasing the set temperature in 1° C. steps, the temperature at which blank dots were produced was taken to be the hot offset temperature. A higher hot offset temperature indicates a better hot offset resistance. The results of the evaluation are given in Table 3.

Evaluation Criteria
A. No blank dots occur at 220° C.
B. Blank dots occur at below 220° C. and at or above 210° C.
C. Blank dots occur at below 210° C. and at or above 200° C.
D. Blank dots occur at below 200° C.

(Evaluation 5) Image Stability

The image stability was evaluated in a normal-temperature, normal-humidity environment (temperature of 23° C., relative humidity of 50%). A4 color laser copy paper (70 g/m$^2$, Canon, Inc.) was used for the media. An initial solid image density was measured; the solid image density was measured after 20,000 prints had been made in intermittent mode of a horizontal line image having a print percentage of 1%; and the density difference was checked (measured using a MacBeth reflection densitometer (MacBeth Corporation)). A smaller density difference indicates a higher image stability. The results of the evaluation are given in Table 3.

Evaluation Criteria
A: The density difference is less than 0.05.
B: The density difference is at least 0.05, but less than 0.10.
C: The density difference is at least 0.10.

Examples 2 to 16

Evaluations were performed as in Example 1, but using the toners as shown in Table 3.

Comparative Examples 1 to 5

Evaluations were performed as in Example 1, but using the toners as shown in Table 4.

TABLE 3

| | | Low-temperature fixability | | Low-temperature fixing non-uniformity | | High-temperature fixing non-uniformity | | | |
|---|---|---|---|---|---|---|---|---|---|
| Example | Toner No. | Rank | Temperature (° C.) | Rank | Gloss non-uniformity (%) | Rank | Gloss non-uniformity (%) | Hot offset Rank | Image stability Rank |
| Example 1 | Toner 1 | A | 172 | A | 1 | A | 1 | A | A |
| Example 2 | Toner 2 | B | 180 | B | 3 | A | 0 | A | A |
| Example 3 | Toner 3 | B | 184 | C | 5 | A | 0 | A | A |
| Example 4 | Toner 4 | B | 187 | C | 8 | A | 0 | A | A |
| Example 5 | Toner 5 | C | 191 | B | 4 | A | 1 | A | A |
| Example 6 | Toner 6 | C | 193 | C | 5 | A | 0 | A | B |
| Example 7 | Toner 7 | A | 176 | C | 7 | A | 1 | A | A |
| Example 8 | Toner 8 | A | 179 | C | 8 | A | 1 | A | A |
| Example 9 | Toner 9 | B | 181 | C | 9 | A | 1 | A | A |
| Example 10 | Toner 10 | A | 169 | A | 1 | B | 3 | A | A |
| Example 11 | Toner 11 | A | 168 | A | 0 | A | 2 | B | A |
| Example 12 | Toner 12 | A | 164 | A | 1 | C | 9 | A | A |
| Example 13 | Toner 13 | A | 162 | A | 0 | B | 3 | B | A |
| Example 14 | Toner 14 | A | 163 | A | 1 | B | 4 | C | A |
| Example 15 | Toner 15 | A | 166 | A | 1 | C | 7 | B | A |
| Example 16 | Toner 20 | A | 171 | A | 1 | A | 1 | A | A |

TABLE 4

| Comparative Example | Toner No. | Low-temperature fixability Rank | Low-temperature fixability Temperature (° C.) | Low-temperature fixing non-uniformity Rank | Low-temperature fixing non-uniformity Gloss non-uniformity (%) | High-temperature fixing non-uniformity Rank | High-temperature fixing non-uniformity Gloss non-uniformity (%) | Hot offset Rank | Image stability Rank |
|---|---|---|---|---|---|---|---|---|---|
| Comparative Example 1 | Toner 16 | B | 188 | D | 11 | D | 12 | A | C |
| Comparative Example 2 | Toner 17 | B | 184 | B | 3 | D | 14 | B | C |
| Comparative Example 3 | Toner 18 | A | 177 | A | 2 | D | 17 | C | C |
| Comparative Example 4 | Toner 19 | D | 203 | D | 11 | C | 9 | A | B |
| Comparative Example 5 | Toner 21 | A | 170 | A | 1 | D | 16 | D | C |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-120149, filed Jun. 27, 2019 which is hereby incorporated by reference herein in its entirety.

What is claimed is:

1. A toner, comprising:

a toner particle that contains a binder resin and a crystalline material;

the crystalline material comprising an ester wax selected from the group consisting of ethylene glycol dibehenate and ethylene glycol distearate, wherein in measurement of powder dynamic viscoelasticity of the toner $$T(A)-T(B)\leq 3.0^\circ\text{ C.}$$

$$45.0^\circ\text{ C.}\leq T(A)\leq 70.0^\circ\text{ C. and}$$

$$4.0\times 10^9\text{ Pa}\leq EA'(100)\leq 6.5\times 10^9\text{ Pa}$$

when T(A°) C. is an onset temperature for a storage elastic modulus E' obtained at a ramp rate of 20° C./min, EA'(100) Pa is a storage elastic modulus at 100° C. obtained at a ramp rate of 20° C./min, and T(B°) C. is an onset temperature for a storage elastic modulus E' obtained at a ramp rate of 5° C./min.

2. The toner according to claim 1, wherein an average number of domains of the crystalline material having a major diameter of from 20 to 300 nm is 50 to 500 in a cross section of the toner observed with a transmission electron microscope.

3. The toner according to claim 2, wherein a content of the ester wax in the crystalline material is from greater than 50.0 to 100.0 mass %.

4. The toner according to claim 1, wherein a peak temperature for a maximum endothermic peak in differential scanning calorimetric measurement of the toner is 60.0 to 90.0° C.

5. The toner according to claim 1, wherein a content of tetrahydrofuran-insoluble matter derived from the binder resin is 20 to 80 mass %.

6. The toner according to claim 1, wherein the binder resin contains an ether structure-bearing vinyl resin.

7. The toner according to claim 6, wherein the vinyl resin is crosslinked by a crosslinking agent having a structure represented by formula (4)

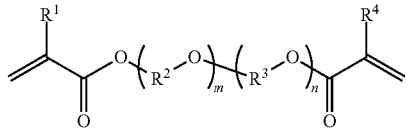

(4)

where m+n is an integer greater than or equal to 2, $R^1$ and $R^4$ are independently H or $CH_3$, and $R^2$ and $R^3$ are independently a straight-chain or branched hydrocarbon group having 2 to 12 carbons.

8. The toner according to claim 7, wherein m+n is an integer greater than or equal to 3.

9. The toner according to claim 7, wherein $R^2$ and $R^3$ are independently a branched hydrocarbon group having 2 to 12 carbons.

* * * * *